US006044787A

United States Patent [19]

Elmbo

[11] Patent Number: 6,044,787

[45] Date of Patent: Apr. 4, 2000

[54] SHIP AND A METHOD ADAPTED TO GENERATE TENSILE STRESSES IN A PULL LINE EXTENDED BETWEEN THE SHIPS AND AN OBJECT TO WHICH A PULL IS TO BE APPLIED

[75] Inventor: Niels Peter Elmbo, Herlev, Denmark

[73] Assignee: A. P. Moller, Copenhagen, Denmark

[21] Appl. No.: 09/029,159

[22] PCT Filed: Aug. 21, 1996

[86] PCT No.: PCT/DK96/00352

§ 371 Date: Jul. 9, 1998

§ 102(e) Date: Jul. 9, 1998

[87] PCT Pub. No.: WO97/08046

PCT Pub. Date: Mar. 6, 1997

[30] Foreign Application Priority Data

Aug. 22, 1995 [DK] Denmark ..... 0935/95

[51] Int. Cl.[7] ..... B63B 21/56; B63B 21/04

[52] U.S. Cl. ..... 114/242; 114/253

[58] Field of Search ..... 114/242, 230.2, 114/230.26, 230.22, 253, 254, 297, 293, 144 B; 242/277

[56] References Cited

U.S. PATENT DOCUMENTS

| | | | |
|---|---|---|---|
| 2,988,892 | 6/1961 | Borrmann et al. | 61/46 |
| 3,151,594 | 10/1964 | Collipp | 114/206 |
| 3,750,607 | 8/1973 | Seymour et al. | 114/65 R |
| 4,476,801 | 10/1984 | Foster et al. | 114/230 |
| 4,760,992 | 8/1988 | Peppel et al. | 254/277 |
| 4,846,446 | 7/1989 | Peppel et al. | 254/277 |
| 4,889,065 | 12/1989 | van der Haak | 114/293 |
| 4,892,262 | 1/1990 | Hurst | 242/157.1 |

FOREIGN PATENT DOCUMENTS

| | | |
|---|---|---|
| 3248717 | 7/1984 | Germany . |
| 2087819 | 6/1982 | United Kingdom . |

*Primary Examiner*—S. Joseph Morano
*Assistant Examiner*—Patrick Craig Muldoon
*Attorney, Agent, or Firm*—Ladas & Parry

[57] ABSTRACT

The present invention concerns a ship which is adapted to generate tensile stresses in a pull line extending between a ship and an object to which a pull is to be applied. The ship, which includes at least one line pull winch, includes equipment in the form of a holding line and a holding line anchorage which is laid out in the desired tensioning direction from the object with a view to generating tensile stresses. At its stern, the ship moreover has at least one line entry opening and force-absorbing line supports for the pull and holding lines. At least one of the supports is adapted to guide the line concerned in a direction toward the line pull winch. The force-absorbing line supports are interconnected via a tension-absorbing constructional element. The resulting ship is capable of generating very high pull forces in a pull line extending in an arbitrary direction from an object to which a pull is to be applied. The invention also concerns a method of applying a pull from a ship of the invention to a pull line, and a use of a ship of the invention for testing the tensile strength of anchorages, for applying a pull to grounded ships and for applying a pull to vessels during towing.

19 Claims, 2 Drawing Sheets

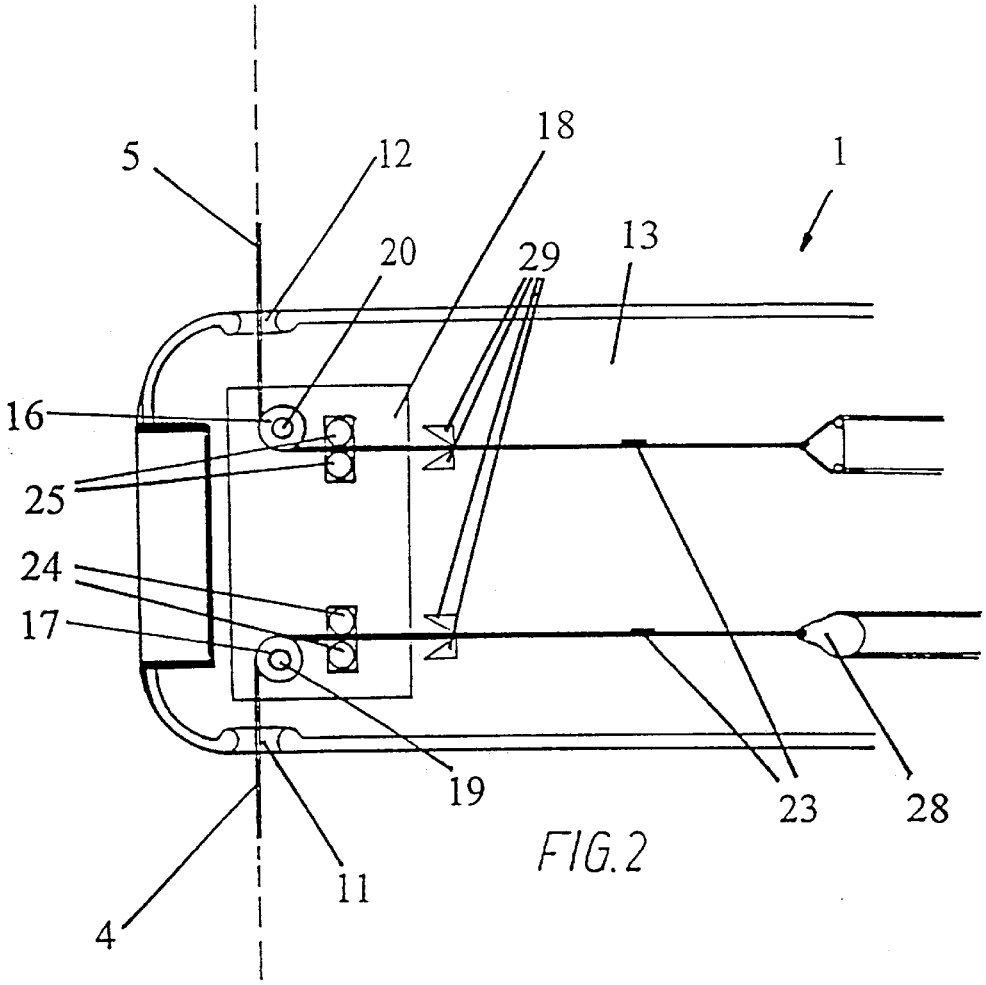
FIG. 2
FIG. 3
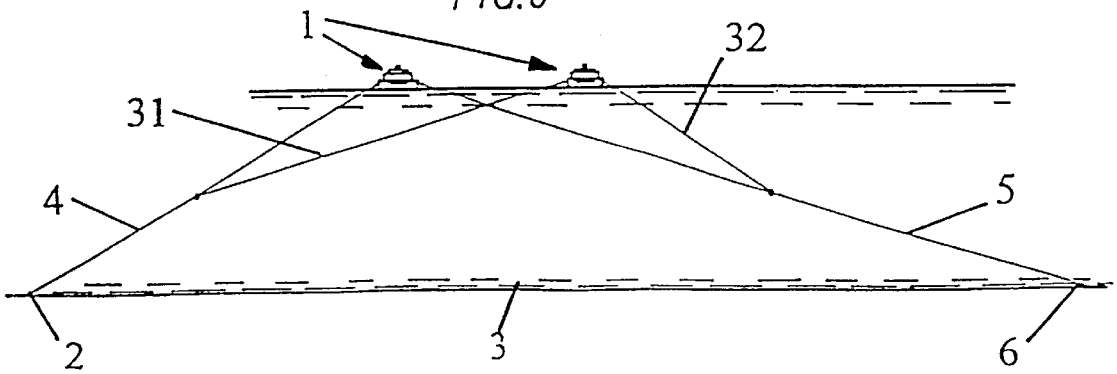

SHIP AND A METHOD ADAPTED TO GENERATE TENSILE STRESSES IN A PULL LINE EXTENDED BETWEEN THE SHIPS AND AN OBJECT TO WHICH A PULL IS TO BE APPLIED

FIELD OF THE ART

The present invention concerns a ship which is adapted to generate tensile stresses in a pull line extending between the ship and an object to which a pull is to be applied, said ship comprising at least one line pull winch.

MOST IMMEDIATE PRIOR ART

The marine industry today includes ships and barges which are used for generating tensile stresses in lines which extend between a ship and an object. The ships/barges are frequently specially designed and can be used only for a specific purpose. The objects may e.g. be anchorages for vessels and offshore structures, grounded ships and ships to be towed.

Thus, within e.g. the offshore industry, specially built anchor handling ships and large crane vessels are used for handling the paying-out and testing of anchoring lines/anchor systems for the production systems. The reason is that today production systems are established at a water depth of up to 800–1200 meters, which makes unusually high demands on the ships/equipment to be used in order for the paying-out and testing of anchoring lines/anchor systems to be handled rapidly and reliably.

It is not unusual that the minimum holding power requirement of the anchoring systems is 700–800 tons for each anchoring line in the anchoring system.

Therefore, the certification authorities make particularly high demands on equipment and testing of the anchoring lines of the anchor systems in order to be sure that the systems satisfy the necessary holding power requirements.

Testing of an anchoring line in a laid anchoring system is impeded to a high degree by the circumstance that the anchored production system is constructed such that the system cannot be subjected to large test forces in a direction opposite to the anchoring line to be tested. Testing must therefore be performed when the line concerned is released from the system, which involves increased difficulty in handling the testing and necessitates execution of time-consuming and laborious operations before the testing is completed.

The use of the ships, crane vessels and equipment known today thus involves very difficult and time-consuming operations when the anchor lines are to be laid out and subsequently tested.

Accordingly, there is a long-felt need for a simplification of these operations and for a simultaneous reduction in the time required to perform these operations.

U.S. Pat. No. 2,988,892 discloses an anchoring system comprising precemented anchoring means. The upper ends of two anchoring lines positioned opposite each other are connected via tackles directly with respective winches on an intermediate barge. The document just teaches pulling at a specific angle and in a specific direction and suggests no structure that allows tensioning of the lines.

However, the barges have not been used in practice, as they are exclusively contemplated for the testing and laying-out of small and simple anchoring system, and further it has been necessary to employ tug boats for slow and cumbersome transport of the barges. Finally, the barge will be unsafe in windy weather, because it does not have the required seaworthiness, so that it is dangerous to be on board the barge.

OBJECT

The object of the invention is to provide a versatile ship of the type mentioned in the opening paragraph, which is capable of safely and efficiently generating tensile stress in arbitrary directions in a pull line extending between the ship and an object without undue time consumption.

THE NOVELTY OF THE SHIP

The ship of the invention is novel in that it comprises equipment in the form of a holding line and a holding line anchorage which is laid out in the desired tensioning direction from the object with a view to generating said tensile stresses, that, at its stern, the ship moreover comprises at least one line entry opening as well as force-absorbing line supports for the pull and holding lines, at least one of said supports being adapted to guide the line concerned in a direction toward the line pull winch, and that the force-absorbing line supports are interconnected via a tension-absorbing constructional element.

ADVANTAGES

The invention thus provides a ship which, in relation to the known ships, is surprisingly capable of generating very high tensile forces in a pull line which extends in an arbitrary direction from an object to which a pull is to be applied.

A further advantage of the invention is that the lines are introduced into the ship in an extremely safe and efficient manner, thereby reducing the risk of accidents.

ADVANTAGES OF ADVANTAGEOUS EMBODIMENTS

Expedient embodiments are defined in claims 2–10.

According to claim 2, the constructional element is adapted to absorb tensile strengths above 200 tons, thereby allowing the ship to used for tasks requiring particularly high forces.

In another embodiment, the line supports are fixedly mounted on the constructional element, which is detachably secured at the quarterdeck of the ship. As a result, the line supports and the constructional element may be removed from the deck of the ship when they are not in use. This results in a versatile ship which may be employed for several different purposes.

According to claim 4, the constructional element is plate-shaped. This provides a compact structure, which is also capable of absorbing large tensile strengths.

In another advantageous embodiment of the Invention, the quarterdeck of the ship comprises hydraulically activatable locking parts to position and secure the constructional element. This ensures simple and efficient attachment of the constructional element. In a particularly expedient embodiment, the locking parts are inclined, so that the constructional element is fixed both horizontally and vertically.

According to claim 6, the line supports are provided in alignment with the line entry openings at the side of the ship. This ensures that the lines are guided perpendicularly inwards toward the ship during tensioning, thereby obviating the need for further line supports.

When the line supports are provided with rotatably mounted guide rollers, the lines are safely given a directional change under a high load with a minimum loss of friction.

According to claim 8, the ship comprises line pull winches to apply a pull to both of said lines. This results in fast and efficient line haul-in and a fixing force twice as large.

According to claim 9, the ship comprises dynamometer means which allow measurement of the tension generated in the pull line. This may be an advantage particularly when it is desired to generate a specific tensile stress in the lines, e.g. during testing.

Finally, according to claim 10, a block is secured at one end of a line to which a pull is applied, through which block an auxiliary line is run, one end of said auxiliary line being fixed, the other end of said auxiliary line being run to the line pull winch to provide a 1:2 change in force between the winch and the line to which a pull is to be applied. This ensures that a great force may be generated in the pull line.

The present invention also concerns a method of applying a pull from the ship to a pull line extending between the ship and an object to which a pull is to be applied. The method is unique in that a holding line anchorage is laid out in the desired tensioning direction from the object, from which anchorage a holding line extends back to the ship, and that the pull line and/or the holding line is subsequently hauled in from the ship while retaining the other of the lines. This ensures that the object may be subjected to a pull in an arbitrary direction.

The invention moreover concerns a use of a ship for testing the tensile strength of anchorages for lines to moor vessels in the open sea, for testing the tensile strength of anchorages for lines to moor offshore structures in the open sea, for applying a pull to grounded ships during salvage of these, and for applying a pull to vessels during towing of these.

MODE OF OPERATION

When the winch of the ship hauls in the holding line and/or the pull line, the lines will be tensioned in extension of each other so as to be stretched between the holding line anchorage and the object to which a pull is to be applied.

When said line or lines are hauled in additionally, the pulling force in the pull line will be transferred from the line support of the pull line on the ship and via the tension-absorbing constructional element to the holding line support on the ship, and from there via the holding line further on to the holding line anchorage.

LIST OF FIGURES

The invention will be explained more fully below with reference to the drawing, in which FIG. 1 is a perspective view of a ship, FIG. 2 is a schematic top view of the stern of the ship, FIG. 3 is a front view of another embodiment using two ships for paying-out or testing the anchorage.

DETAILED DESCRIPTION OF ADVANTAGEOUS EMBODIMENTS

Figure 1:
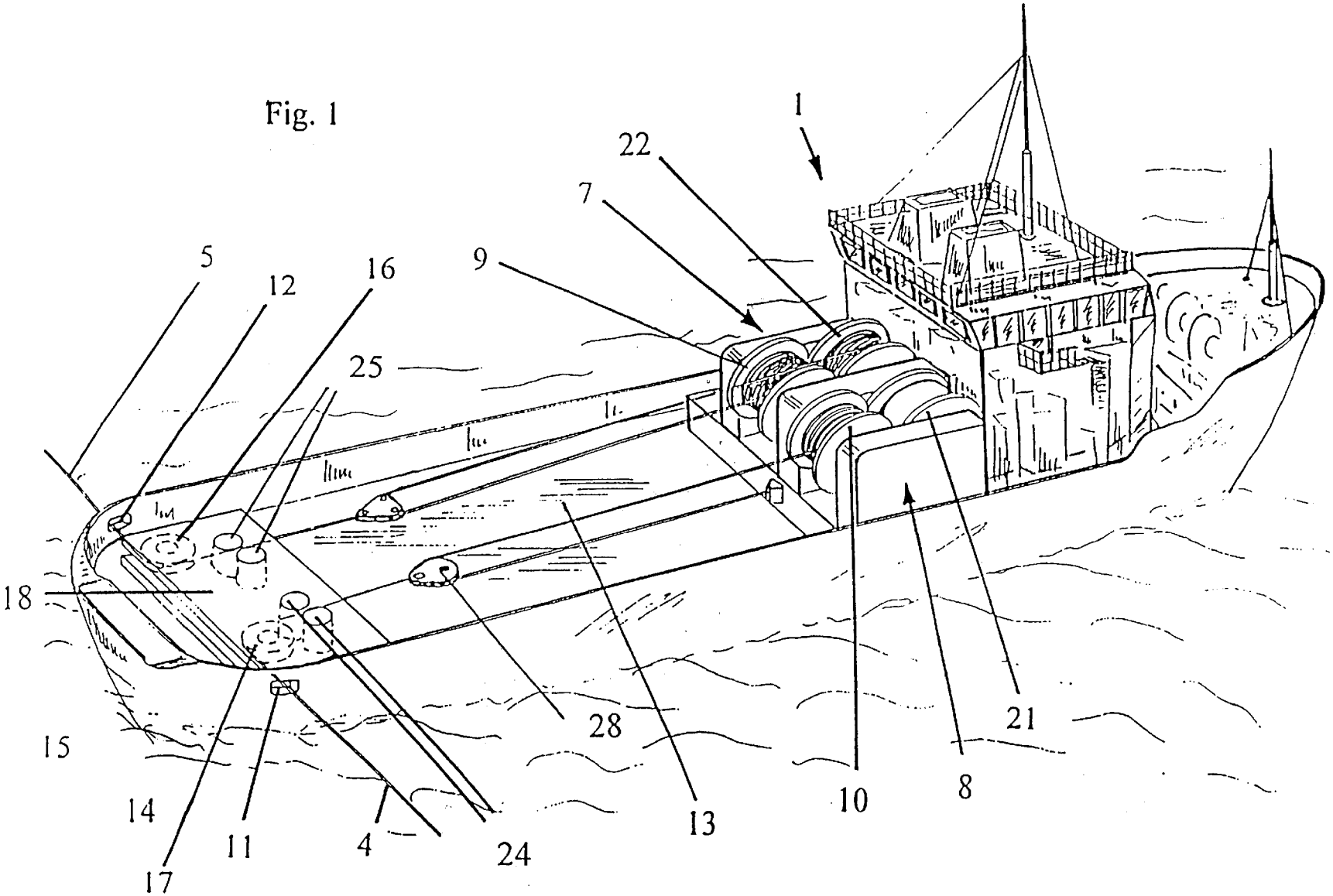

The ship 1 shown in FIG. 1 is adapted to generate tensile stresses in a pull line 4 extending between the ship 1 and an object (not shown) to be subjected to a pull.

The ship 1 comprises two line pull winches 7, 8. In addition, the ship 1 comprises a holding line 5 and a holding line anchorage 6 paid out in the desired tensioning direction from the object to generate tensile stresses. The ship 1 moreover comprises two line entry openings 11, 12 at its stern and force-absorbing line supports 16, 17 for the pull and the holding lines. The force-absorbing line supports 16, 17, which are adapted to guide the line concerned in a direction toward the line pull winches 7, 8, are interconnected via a tension-absorbing constructional element 18.

The line supports 16, 17 are fixedly mounted on the constructional element 18 so that the forces applied by the lines 4, 5 to the line supports 16, 17 are safely transferred to the constructional element 18.

In the embodiment shown, the constructional element 18 is provided as an upper plate and a lower plate positioned in parallel opposite each other with a space between them. The constructional element might also have other shapes, as the term constructional element is intended to mean beams, plates, etc. which have a sufficient strength to absorb the loads.

In the embodiment shown, the constructional element 18 is detachably secured at the quarterdeck 13 of the ship. It is ensured hereby that the constructional element 18 can be removed from the quarterdeck 13 of the ship so that the ship 1 may also be used for other types of tasks, without the constructional element 18 taking up undue space. Thus, the constructional element having the premounted line supports 16, 17 arranged on the plates, may be installed quickly on the ship when required, resulting in a versatile ship useful for several purposes.

The constructional element 18 is secured and positioned with respect to the ship 1 via hydraulically activatable locking parts 24, 25 which are mounted in the quarterdeck 13 of the ship. The locking parts 24, 25 are provided as two pairs of legs which, when being activated, move obliquely upwards from the quarterdeck 13 toward each other by means of a hydraulic device (not shown). The constructional element 18 thus comprises corresponding openings so that the constructional element 18 is fixed vertically as well as horizontally when the locking parts 24, 25 are moved up through the openings in the constructional element 18.

The tension-absorbing constructional element 18 is adapted to absorb tensile forces above 200 tons in the embodiment shown. The ship 1 may hereby be used for generating extremely great tensile stresses.

The ship moreover comprises two line entry openings 11, 12 which are arranged in the starboard side and the port side, respectively, of the ship 1 at the stern of the ship. The line entry openings 11, 12 are arranged at a level above the deck 13 of the ship. In use, the pull line 4 is passed from the object and the holding line 5 from the holding line anchorage through their respective line entry openings 11, 12 and further via the line supports 16, 17 to the line pull winches 7, 8, see FIG. 2. During tensioning of the lines, the high forces will cause the ship 1 to assume such a position that the lines enter the deck substantially perpendicularly to the fore-and-aft direction of the ship, as appears from FIG. 1.

In the embodiment shown, the line supports 16, 17 are provided in alignment with the line entry openings 11, 12 at the side of the ship, and are formed by two rotatably mounted guide rollers. The guide rollers, which are mounted on their respective vertical shafts 19, 20 secured to the upper and lower plates in the constructional element 18, are arranged between the upper plate and the lower plate.

As shown in FIG. 2, the line supports 16, 17 are arranged such that, in use, they guide the lines 4, 5 from a direction which is substantially perpendicular to the fore-and-aft direction of the ship to a direction which is substantially parallel with the fore-and-aft direction of the ship and which extends in a direction toward the line pull winches 7, 8. In use, the guide rollers thus guide the lines 4, 5 from the line entry openings 11, 12 to the line pull winches 7, 8 in a safe and reliable manner.

The ship 1 also comprises two line pull winches 7, 8 to apply a pull to both of said lines. Each line pull winch 7, 8 consists of two drums 9, 10, 21, 22. Depending on the desired pull strength and the amount of line to be pulled in to generate a tensile stress in the pull line 4, one or two line pull winches 7, 8 and one or more drums may be used. Each of the winches 7, 8 can pull with a force of up to about 850 tons in the embodiment shown.

As shown in FIG. 1, the line pull winches 7, 8 are placed approximately amidships with the axes of the drums 9, 10, 21, 22 extending horizontally and perpendicularly to the fore-and-aft direction of the ship. However, the winches 7, 8 might also be arranged at other places and in other ways without departing from the idea of the invention. When the winches are arranged amidships and the line supports 16, 17 at the stern of the ship, however, it is ensured that there is a great spacing between these parts, which provides a larger area in which the tensioning may take place.

The line pull winches 7, 8 night also consist of just one drum, which results in a simpler structure. However, a greater pulling force may be obtained by using several drums in each winch. Further, when several drums are used, one may be employed for initial winding-up of the line, and the other drum may then be activated just at the final tensioning where the force requirement is particularly great, frequently above 500 tons.

In the embodiment described in which the line pull winches 7, 8 are placed amidships, already existing ships may be used. Thus, it is not necessary to use specially built anchor handling ships or large crane vessels.

The ship moreover comprises gripper arms 29 which we arranged immediately in front of the hydraulically activatable locking parts 19, 20. The gripper arms are used for securing the lines 4, 5 during tensioning, as tensioning takes place in several steps.

As shown in FIGS. 1 and 2, a block 28 may be mounted at the end of the line to which a pull is applied, through which block an auxiliary line is passed. One end of the auxiliary line is fixed, and its other end is run to the line pull winch with a view to obtaining a 1:2 change in force between the winch and the line to which a pull is to be applied.

Finally, the ship 1 comprises a means 23 for measuring force, which may be adapted to perform a controlled measurement of the line load. Said means may be constructed as a strain gauge which is mounted on one or more of the lines, as shown in FIG. 2, but may e.g. also be incorporated in the line pull winches so that the load on the winches is recorded.

When the ship 1 of the invention is used, a pull line 4 is extended between the ship 1 and the object to which a pull is to be applied. Further a holding line anchorage 6 is laid out in the desired tensioning direction from the object, and a holding line 5 is fixed between this anchorage 6 and the ship. Then, at least one line is wound up by means of the line pull winch 7, 8 of the ship 1. Depending on i.e. the required pull, one or more winches and one or more drums may be used. During tensioning, the lines 4, 5 are guided into the ship 1, as shown in FIG. 1 and explained above. The gripper arms 29 are used for securing the lines 4, 5 in connection with change of block 28 and drum 8, 9, 21, 22.

The present invention also concerns a method of applying a pull force from a ship 1 of the invention to a pull line 4 extended between the ship 1 and an object to which a pull is to be applied. The method comprises laying out a holding line anchorage 6 in the desired tensioning direction from the object, and a holding line 5 extends from the anchorage 6 back to the ship 1. The pull line 4 and/or the holding line 5 is hauled in from the ship 1, while retaining the other of the lines, thereby applying a pull to the pull line 4.

The invention also concerns uses of the ship 1 of the invention.

Thus, the ship 1 of the invention may be used for testing the tensile strength of anchorages for lines to moor vessels or offshore structures in the open sea. In this context, offshore structures are taken to include structures such a drilling platforms, floating production vessels, and loading buoy systems, and frequently the anchoring takes place at a water depth of up to 800–1200 meters.

The invention also concerns a use or the ship 1 of the invention for applying a pull to grounded ships during salvage of these. It is hereby made possible to pull a grounded ship off the ground using fewer ships than is normally the case, as a particularly great pulling force may be provided using the ship 1 of the invention. Thus, today more ships are used for pulling grounded ships off the ground, as they just use their engine power for pulling and do not hold any holding anchoring means.

Finally, the invention also concerns a use of a ship 1 for applying a pull to vessels during towing of these.

Thus, it is shown in FIG. 3 how two ships 1 may be used for generating tensile stresses in a pull line 4. The ships 1 are connected to each other by means of two auxiliary lines 31, 32 so that both ships 1 are connected to the pull line 4 as well as the holding line 5. This provides a doubled tensile stress.

Many modifications may be made without departing from the idea of the invention. For example, the line entry opening may be provided as a cut-out in the hull of the ship or may e.g. be shaped as a well.

I claim:

1. A ship (1) for applying a pull to an object by simultaneously generating tensile stresses in a pull line (4) laid out between said ship (1) and said object and in a holding line (5) laid out between said ship (1) and a holding line anchorage (6), said ship (1) comprising a quarterdeck (13), at least one line pull winch (7,8) arranged on said quarterdeck (13) for generating said tensile stresses, a pull line entry and a holding line entry arranged on respective sides of said ship (1), a force-absorbing line support (17) for said pull line (4) and a force-absorbing line support (16) for said holding line (5), a separate tension-absorbing constructional element (18), said force-absorbing line supports being interconnected by and mounted on said tension-absorbing constructional element (18), securing means for detachably securing said constructional element (18) to said quarterdeck of said ship (1) in a fixed position with respect to said quarterdeck, at least one of said line supports being adapted to guide the pull line or holding line in a direction toward said at least one line pull winch (7, 8) in said fixed position.

2. A ship (1) according to claim 1, wherein the constructional element is adapted to absorb tensile strengths above 200 tons.

3. A ship according to claim 2, wherein the constructional element is plate-shaped.

4. A ship (1) according to claim 1, wherein the constructional element is plate-shaped.

5. A ship (1) according to claim 1, wherein said constructional element (18) has openings and said securing means for detachably securing said constructional element (18) comprises hydraulically activatable locking parts (24, 25) adapted to engage said openings to establish said fixed position.

6. A ship (1) according to claim 1, wherein said line supports (16, 17) are provided in alignment with said line entries (11, 12).

7. A ship (1) according to claim 1, wherein said line supports (16, 17) are formed by rotatably mounted guide rollers.

8. A ship (1) according to claim 1, comprising a second line pull winch (7, 8), said at least one line pull winch and said second line pull winch being disposed for applying a pull to respective of said lines.

9. A ship (1) according to claim 1, said ship having force-measuring means (23) adapted to perform a controlled measurement of a line load.

10. A ship (1) according to claim 1, wherein a block is mounted at the end of said pull line, through which block an auxiliary line is run, one end of said auxiliary line being fixed, a second end of said auxiliary line being run to the at least one line pull winch to provide a 1:2 change in force between the winch and the line to which a pull is to be applied.

11. A method comprising applying a pull from the ship according to claim 1, to the pull line (4) by (a) laying out the holding line anchorage (6) in a desired tensioning direction from the object, with the holding line (5) extending from the anchorage (6) back to the ship, and (b) hauling in the pull line or the holding line or both from the ship.

12. A method according to claim 11, comprising hauling the pull line in from the ship while retaining the holding line.

13. A method according to claim 11, comprising hauling the holding line in from the ship while retaining the pull line.

14. A ship (1) for applying a pull to an object by simultaneously generating tensile stresses in a pull line (4) laid out between said ship (1) and said object and in a holding line (5) laid out between said ship (1) and a holding line anchorage (6), said ship (1) comprising a quarterdeck (13), at least one line pull winch (7, 8) arranged on said quarterdeck (13) for generating said tensile stresses, a pull line entry and a holding line entry arranged on respective sides of said ship (1), a force-absorbing line support (17) for said pull line (4) and a force-absorbing line support (16) for said holding line (5), an elongated tension-absorbing constructional element (18) having respective ends and being arranged in a fixed position with respect to said quarterdeck, said force-absorbing line supports (16, 17) being mounted on either end of said tension-absorbing constructional element (18), said tension-absorbing constructional element (18) being adapted to absorb the forces applied by said lines, and at least one of said line supports being adapted to guide the pull line or holding line in a direction toward the at least one line pull winch (7, 8).

15. A ship (1) according to claim 14, wherein the constructional element is adapted to absorb tensile strengths above 200 tons.

16. A ship (1) according to claim 14, wherein said line supports (16, 17) are provided in alignment with said line entries (11, 12).

17. A ship (1) according to claim 14, wherein said line supports (16, 17) are formed by rotatably mounted guide rollers.

18. A ship (1) according to claim 14, comprising a second line pull winch (7, 8), said at least one line pull winch and said second line pull winch being disposed for applying a pull to respective of said lines.

19. A ship (1) according to claim 14, said ship having force-measuring means (23) adapted to perform a controlled measurement of line load.

* * * * *